US009050792B2

(12) United States Patent
Fukuda

(10) Patent No.: US 9,050,792 B2
(45) Date of Patent: Jun. 9, 2015

(54) LIQUID EJECTING APPARATUS AND METHOD OF CONTROLLING LIQUID EJECTING APPARATUS

(71) Applicant: SEIKO EPSON CORPORATION, Tokyo (JP)

(72) Inventor: Shunya Fukuda, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/333,073

(22) Filed: Jul. 16, 2014

(65) Prior Publication Data

US 2015/0022593 A1 Jan. 22, 2015

(30) Foreign Application Priority Data

Jul. 19, 2013 (JP) ..... 2013-150109
Oct. 24, 2013 (JP) ..... 2013-220729

(51) Int. Cl.
*B41J 2/045* (2006.01)

(52) U.S. Cl.
CPC ..... *B41J 2/0453* (2013.01); *B41J 2/04581* (2013.01)

(58) Field of Classification Search
CPC .. B41J 2/0453; B41J 2/04581; B41J 2/14201; B41J 2/14209; B41J 2002/14217; B41J 2002/14225; B41J 2/14233; B41J 2002/14241; B41J 2002/1425; B41J 2002/14258; B41J 2002/14266; B41J 2/14274; B41J 2/14282; B41J 2/1429
See application file for complete search history.

(56) References Cited

U.S. PATENT DOCUMENTS 7,699,442 B2 * 4/2010 Lim et al. ..... 347/70

FOREIGN PATENT DOCUMENTS

JP 2004-262242 9/2004

* cited by examiner

*Primary Examiner* — Geoffrey Mruk
(74) *Attorney, Agent, or Firm* — Workman Nydegger

(57) ABSTRACT

A pressure chamber array includes one or more dummy pressure chambers in which ejection of ink is not performed, the dummy pressure chamber includes a piezoelectric element, and a drive potential generator continues to apply a drive potential to the piezoelectric element corresponding to the dummy pressure chamber, while the ejection of the ink from a nozzle of at least a pressure chamber adjacent to the dummy pressure chamber is performed.

6 Claims, 8 Drawing Sheets

LIQUID EJECTING APPARATUS AND METHOD OF CONTROLLING LIQUID EJECTING APPARATUS

CROSS-REFERENCE TO RELATED APPLICATIONS

The present application claims priority to Japanese Patent Application No. 2013-150109 filed on Jul. 19, 2013, and Japanese Patent Application No. 2013-220729 filed on Oct. 24, 2013, which applications are hereby incorporated by reference in their entirety.

BACKGROUND

1. Technical Field

The present invention relates to a liquid ejecting apparatus such as an ink jet type recording apparatus, and a method of controlling the liquid ejecting apparatus, and particularly to a liquid ejecting apparatus which drives a piezoelectric element by applying a drive potential to the piezoelectric element and thus causing liquid to be ejected from a nozzle, and a method of controlling the liquid ejecting apparatus.

2. Related Art

A liquid ejecting apparatus includes liquid ejecting heads, and is an apparatus which ejects (discharges) various liquids from the liquid ejecting heads. As the liquid ejecting apparatus, there is an image recording apparatus such as an ink jet type printer or an ink jet type plotter, but recently, for utilizing a feature that a very small amount of liquid can be landed exactly at a predetermined position, the liquid ejecting apparatus has also been applied to various manufacturing apparatuses. For example, the liquid ejecting apparatus is applied to a display manufacturing apparatus which manufactures a color filter of a liquid crystal display or the like, an electrode forming apparatus which forms an electrode of an organic EL (electro luminescence) display, an FED (field emission display) or the like, and a chip manufacturing apparatus which manufactures a biochip (biochemical element). Subsequently, a recording head for the image recording apparatus ejects ink of liquid form, and a color material ejecting head for a display manufacturing apparatus ejects liquids of each of color materials of R (Red), G (Green), and B (Blue). In addition, an electrode material ejecting head for an electrode forming apparatus ejects liquid electrode material, and a bio organic material ejecting head for a chip manufacturing apparatus ejects liquid of bio-organic material.

A recording head mounted on a printer is configured in such a manner that ink from an ink supply source such as an ink cartridge flows into a pressure chamber, a drive potential (drive voltage) is applied to a piezoelectric element thereby operating the piezoelectric element and then a pressure variation occurs in the ink in the pressure chamber, and by using the pressure variation, the ink in the pressure chamber is ejected from a nozzle as ink droplets. In addition, with regard to pressure chambers (hereinafter, appropriately, referred to as end portion pressure chambers) which are positioned at both ends in a linear alignment direction among a plurality of linearly aligned pressure chambers, on one side of the end portion pressure chamber, other pressure chambers are adjacent to each other with partition walls therebetween, while on the other side of the end portion pressure chamber, a wall with a high rigidity and thicker than the partition wall between the pressure chambers is provided. Since it is difficult for this wall to be deformed even by the pressure variation when compared with the partition wall between the pressure chambers, pressure loss at the time of ejection of the liquid in the end portion pressure chamber is small when compared with that of a pressure chamber (pressure chamber which is positioned inside in the linear alignment direction with respect to the end portion pressure chambers) other than the end portion pressure chambers. As a result, a difference of pressure loss occurs between pressure chambers which are positioned on the inside and pressure chambers which are positioned at both ends, among the plurality of linearly aligned pressure chambers, and thereby differences in an amount of liquid ejected from the nozzle and in flying speed (ejection characteristics) occur.

With regard to this point, a recording head in which a dummy pressure chamber that is adjacent to the end portion pressure chamber and does not perform the ejection of liquid is formed, is also proposed (for example, refer to JP-A-2004-262242). That is, when providing the dummy pressure chamber so as to be adjacent to the end portion pressure chamber, partition walls with the same strength can be provided on both sides of the end portion pressure chamber, and thereby conditions on structures of the end portion pressure chambers can be made uniform to the same degree as those of other pressure chambers which are positioned on the inside. Furthermore, the ink of the same type as the ink filled into the other pressure chambers is filled into the dummy pressure chamber. As a result, it is possible to make uniform the pressure loss at the end portion pressure chamber and the pressure chambers on the inside, when the liquid is ejected.

However, recently, for this type of recording head, in order to respond to requirements for image quality improvement of the recorded image or miniaturization of the recording head, an increase in density of nozzles has progressed further. As a result, pressure chambers in communication with each nozzle has also been formed with high density, and a partition wall which partitions pressure chambers adjacent to each other has tended to become thinner. In addition, based on an advantage that a shape of a small pressure chamber can be formed with a high dimensional accuracy, a single crystal silicon substrate can be used as a material for forming the pressure chamber. The rigidity of the partition wall in a case where the pressure chamber is formed by a single crystal silicon substrate is weak, when compared with that of a metal such as stainless steel. Due to circumstances such as these, there have been lots of cases where it has been difficult to make uniform ejection characteristics of the end portion pressure chambers and pressure chambers on the inside at the time of the ejection of the liquid, only by simply providing a dummy pressure chamber.

In addition, such a problem exists not only in an ink jet type recording apparatus on which a recording head that ejects ink is mounted, but also in other liquid ejecting apparatuses which eject liquid from a nozzle by generating a pressure variation in the liquid in a pressure chamber.

SUMMARY

An advantage of some aspects of the invention is to provide a liquid ejecting apparatus which can make uniform the ejection characteristics of each linearly aligned pressure chamber, and a method of controlling the liquid ejecting apparatus.

According to an aspect of the invention, there is provided a liquid ejecting apparatus including: a liquid ejecting head that includes a nozzle array formed of a plurality of nozzles, a pressure chamber array formed of a plurality of pressure chambers provided along the nozzle array, and a plurality of piezoelectric elements which generate a pressure variation of liquid in each pressure chamber; and a drive potential generator that generates a drive potential which drives the piezoelectric element. The pressure chamber array includes one or more dummy pressure chambers in which ejection of the liquid is not performed, and the dummy pressure chamber includes the piezoelectric element. The drive potential generator continues to apply the drive potential to the piezoelectric element corresponding to the dummy pressure chamber, while the ejection of the liquid from a nozzle of at least a pressure chamber adjacent to the dummy pressure chamber is performed.

In addition, "while ejection of the liquid is performed" means a period in which the drive potential for ejecting the liquid is applied to the piezoelectric element of at least a pressure chamber adjacent to the dummy pressure chamber.

In this case, during the period in which the ejection of the liquid from the nozzle in at least a pressure chamber adjacent to the dummy pressure chamber is performed, the drive potential is continuously applied to the piezoelectric element corresponding to the dummy pressure chamber, thus the piezoelectric element is tensed to support the partition wall between the pressure chamber adjacent to the dummy pressure chamber and the dummy pressure chamber from the side. As a result, even if an internal pressure of the adjacent pressure chamber increases, the partition wall is suppressed from being deformed (bent) toward the dummy pressure chamber side. Due to this, it is possible to reduce pressure loss toward the dummy pressure chamber side from the pressure chamber adjacent to the dummy pressure chamber. Since the partition wall is supported by the tense piezoelectric element, the rigidity of the partition wall is not excessively great, when compared with a configuration (configuration in which a portion corresponding to the dummy pressure chamber is a wall having a greater rigidity than that of the partition wall) in which the dummy pressure chamber is not provided. Thus, it is possible to make uniform a deformation degree of the partition wall on the dummy pressure chamber side and a deformation degree of the partition wall on the other pressure chamber side to the same degree, when the pressure variation occurs in the pressure chamber adjacent to the dummy pressure chamber. As a result, it is possible to make uniform the pressure loss due to a propagation of the pressure variation to the same degree as in other pressure chambers, regardless of the position of the pressure chamber. As a result, it is possible to make uniform characteristics of the ejection of the liquid of each pressure chamber in the pressure chamber array. Due to this, it is possible to cope with a high density of the nozzles (pressure chambers) or miniaturization of the liquid ejecting head. In addition, it is suitable in a case where a substrate which forms the pressure chamber is produced by materials with a relatively weak rigidity such as a single crystal silicon substrate.

In the liquid ejecting apparatus, a drive potential which is applied to the piezoelectric element of the dummy pressure chamber may be a reference potential which has an ejection drive waveform and causes the piezoelectric element of other pressure chambers to perform the ejection of the liquid.

In this case, since the drive potential which is applied to the piezoelectric element of the dummy pressure chamber is the reference potential which has an ejection drive waveform and causes the piezoelectric element of other pressure chambers to perform the ejection of the liquid, it is possible to average approximately the rigidities of the partition walls on both sides of the pressure chamber adjacent to the dummy pressure chamber, and to easily make uniform the ejection characteristics, regardless of the ejection or non-ejection of the liquid in a pressure chamber adjacent to the pressure chamber adjacent to the dummy pressure chamber.

In the liquid ejecting apparatus, the pressure chamber array may be divided into a plurality of pressure chamber arrays, and the dummy pressure chamber may be formed on both sides of each pressure chamber array.

In this case, the pressure chamber array is divided into a plurality of pressure chamber arrays and the dummy pressure chamber is formed on both sides of each pressure chamber array, and thus, configuring in such a manner that liquids of types different from each other flow into each pressure chamber is suitable. That is, it is not necessary to provide a dedicated nozzle array (pressure chamber array) or a dedicated liquid ejecting head for each liquid type, and it is possible to cope with multiple types of liquids with one nozzle array (pressure chamber array).

In addition, in the liquid ejecting apparatus, the liquid may not flow into the dummy pressure chamber.

In this case, the drive potential is applied to the piezoelectric element of the dummy pressure chamber so as to tense the piezoelectric element thereby supporting the partition wall, and thus, although the ink is not filled into the dummy pressure chamber, it is possible to make uniform a deformation degree of the partition wall on the dummy pressure chamber side and a deformation degree of the partition wall on the other pressure chamber side to the same degree, when the pressure variation occurs in the pressure chamber adjacent to the dummy pressure chamber.

In addition, in the liquid ejecting apparatus, the liquid of the same type as the liquid which flows into the pressure chamber adjacent to the dummy pressure chamber may flow into the dummy pressure chamber.

In this case, the liquid is filled into the dummy pressure chamber in the same manner as in other pressure chambers, and thus, it is possible to make uniform contraction stress on the liquid in the dummy pressure chamber with contraction stress on the liquid in each pressure chamber, when the pressure variation occurs in the pressure chamber adjacent to the dummy pressure chamber. Due to this, it is possible to make uniform more reliably the ejection characteristics of each pressure chamber.

According to another aspect of the invention, there is provided a method of controlling a liquid ejecting apparatus which includes a liquid ejecting head that includes a nozzle array formed of a plurality of nozzles, a pressure chamber array formed of a plurality of pressure chambers provided along the nozzle array, and a plurality of piezoelectric elements which generate a pressure variation of liquid in each pressure chamber; and a drive potential generator that generates a drive potential which drives the piezoelectric element, and in which the pressure chamber array includes one or more dummy pressure chambers in which ejection of the liquid is not performed, and the dummy pressure chamber includes the piezoelectric element, the method including: continuously applying the drive potential to the piezoelectric element corresponding to the dummy pressure chamber, while the ejection of the liquid from a nozzle of at least a pressure chamber adjacent to the dummy pressure chamber is performed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to the attached drawings. In addition, in the embodiments described below, various limitations are made as preferable specific examples of the invention, but if there is no description to the effect that the invention is particularly limited in the following description, the scope of the invention is not limited thereto. In addition, in the following description, an ink jet type recording apparatus (hereinafter, printer) will be described as an example of a liquid ejecting apparatus of the invention.

Figure 1:
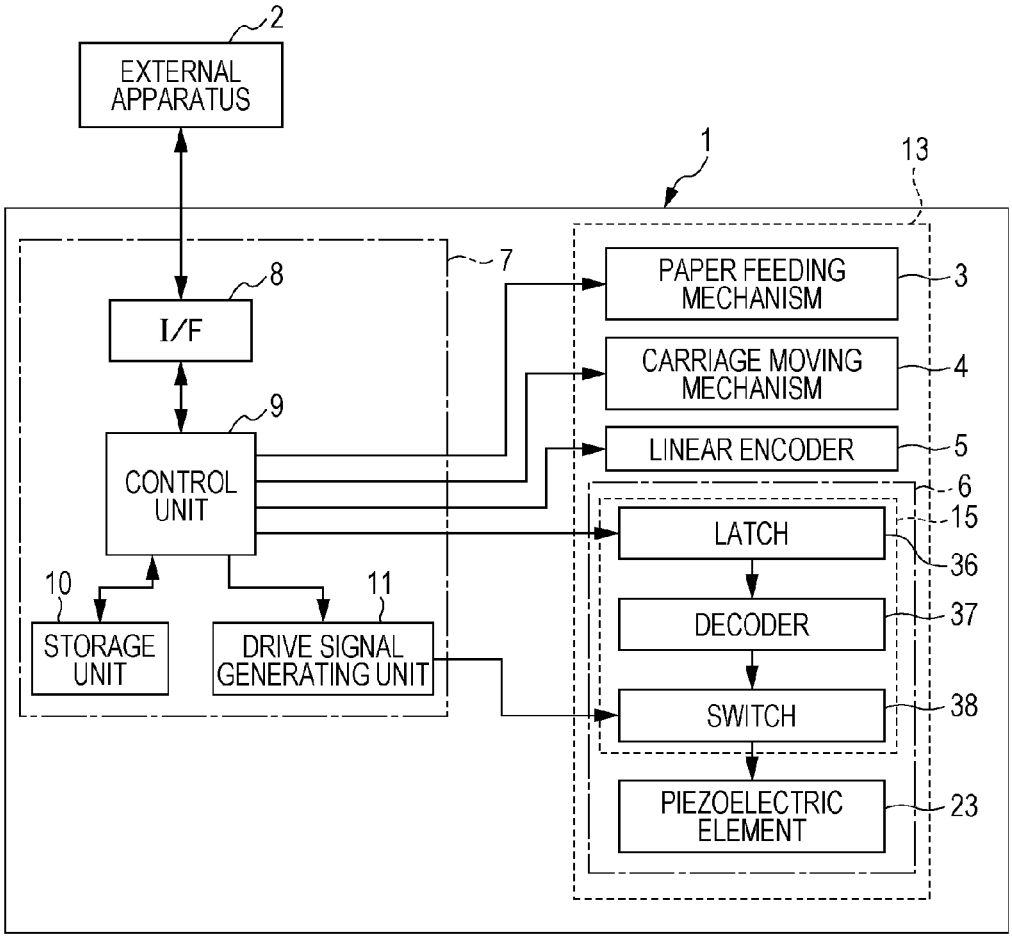
FIG. 1 is a block diagram for explaining an electrical configuration of a printer.
Figure 2:
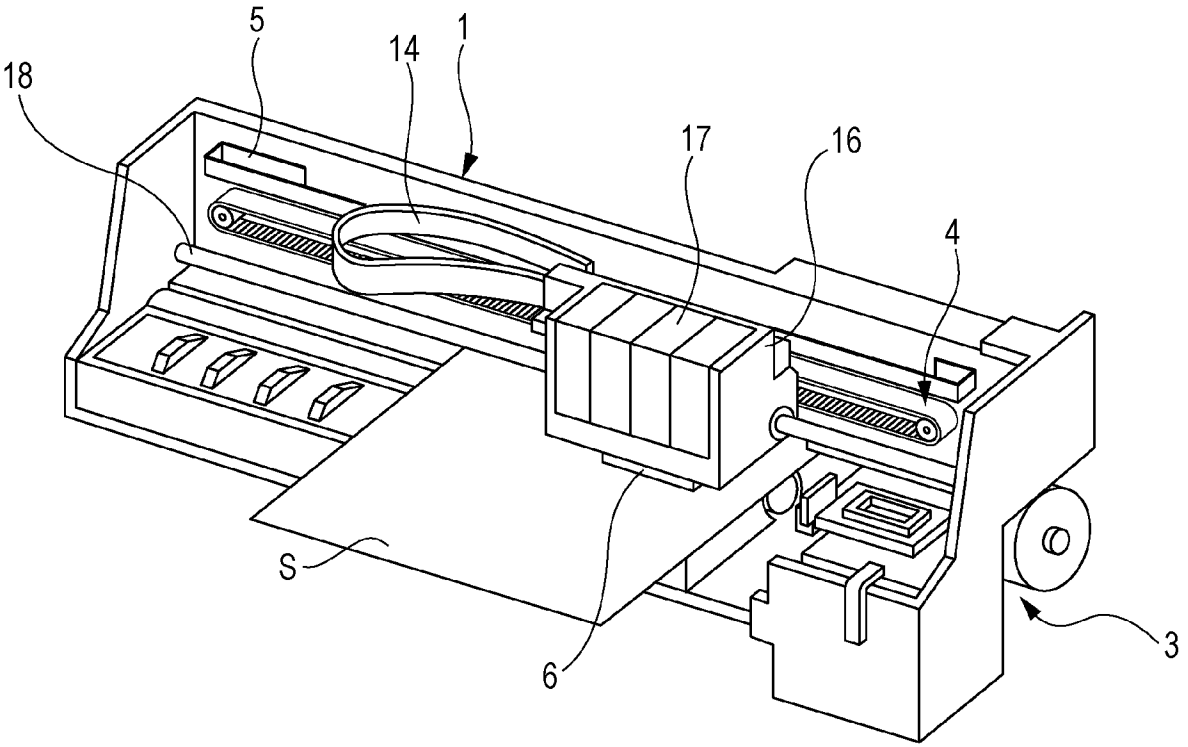
FIG. 2 is a perspective view for explaining an internal configuration of the printer.

FIG. 1 is a block diagram for explaining an electrical configuration of a printer 1, and FIG. 2 is a perspective view for explaining an internal configuration of the printer 1. An external apparatus 2 is an electronic device such as a computer, a digital camera, a mobile phone, or a portable information terminal. The external apparatus 2 is electrically connected to the printer 1 wirelessly or in a wired manner, and in order to print an image or text on a recording medium S such as recording paper in the printer 1, transmits print data according to the image or the like to the printer 1.

The printer 1 of the present embodiment includes a print engine 13 such as a paper feeding mechanism 3, a carriage moving mechanism 4, a linear encoder 5, and a recording head 6, and a printer controller 7. The recording head 6 is attached to a bottom surface side of a carriage 16 on which an ink cartridge 17 (liquid supply source) is mounted. The carriage 16 is configured so as to be able to move back and forward along a guide rod 18 using the carriage moving mechanism 4. That is, the printer 1 transports in sequence a recording medium S (one kind of landing target) such as recording paper using the paper feeding mechanism 3, relatively moves the recording head 6 in a width direction (main scan direction) of the recording medium S with respect to the recording medium and simultaneously ejects ink from nozzles 25 (refer to FIG. 3) of the recording head 6, and thereby an image or the like is recorded by landing the ink on the recording medium S. In addition, it is also possible to employ a configuration in which the ink cartridge 17 is arranged on a main body side of the printer and the ink of the ink cartridge 17 is transferred to the recording head 6 side via a supply tube.

Figure 5A:
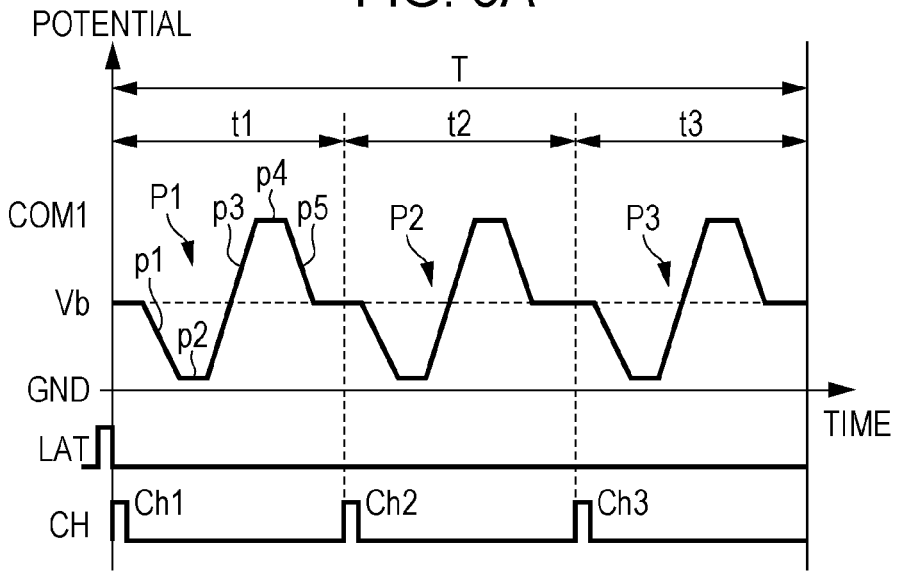
FIGS. 5A and 5B are waveform diagrams for explaining a configuration of a drive signal.
Figure 5B:
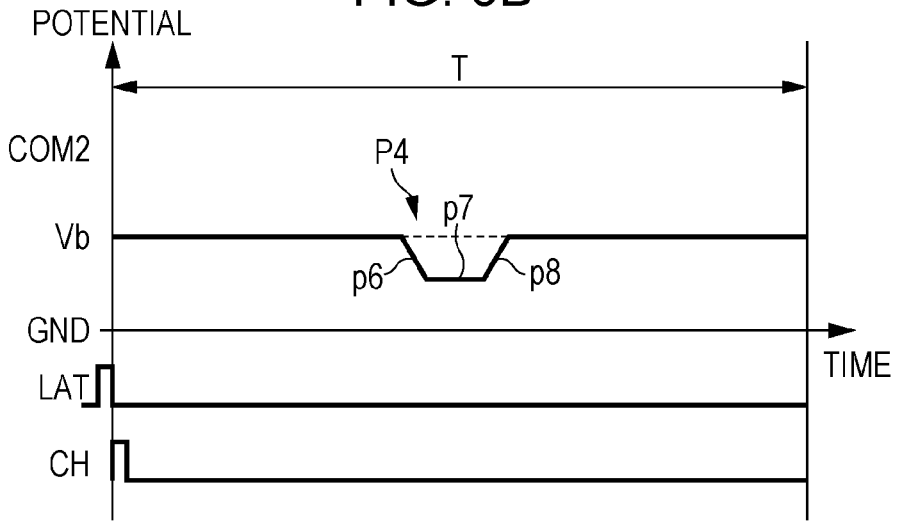

The printer controller 7 is a control unit which performs a control of each unit of the printer. The printer controller 7 according to the present embodiment includes an interface (I/F) unit 8, a control unit 9, a storage unit 10, and a drive signal generating unit 11. The interface unit 8 transfers print data or a print command from the external apparatus 2 to the printer 1, and when state information of the printer 1 is output to the external apparatus 2 side, performs transmission and reception of state data of the printer. The control unit 9 is an arithmetic processing apparatus for performing overall control of the printer. The storage unit 10 is an element which stores data used for a program or various controls of the control unit 9, and includes a ROM, a RAM, and an NVRAM (non-volatile memory element). The control unit 9 controls each unit according to the programs stored in the storage unit 10. In addition, based on the print data from the external apparatus 2, the control unit 9 according to the present embodiment generates ejection data which indicates from which nozzle 25 and at which timing the ink is ejected at the time of a recording operation, and transmits the ejection data to a head control unit of the recording head 6. Based on waveform data regarding a waveform of the drive signal, the drive signal generating unit 11 generates an analog signal, amplifies the signal, and generates drive signals COM (COM1 and COM2) as illustrated in FIGS. 5A and 5B.

Next, the print engine 13 will be described. The print engine 13, as illustrated in FIG. 1, includes the paper feeding mechanism 3, the carriage moving mechanism 4, the linear encoder 5, the recording head 6, and the like. The carriage moving mechanism 4 is formed of the carriage 16 to which the recording head 6 that is a kind of liquid ejecting head is attached, a driving motor (for example, DC motor) (not illustrated) which makes the carriage 16 travel via a timing belt or the like, and the like, and moves the recording head 6 mounted on the carriage 16 in the main scan direction. The paper feeding mechanism 3 is formed of a paper feeding motor, a paper feeding roller and the like, and performs a sub-scan by delivering in sequence the recording medium S on a platen. In addition, the linear encoder 5 outputs an encoder pulse according to a scan position of the recording head 6 mounted on the carriage 16 to the printer controller 7 as position information in the main scan direction. Based on the encoder pulse received from the linear encoder 5, the control unit 9 of the printer controller 7 can ascertain the scan position (current position) of the recording head 6. In addition, based on the encoder pulse, the control unit 9 generates a timing signal (latch signal LAT) which defines a timing of generating the drive signal COM described later.

Figure 3:
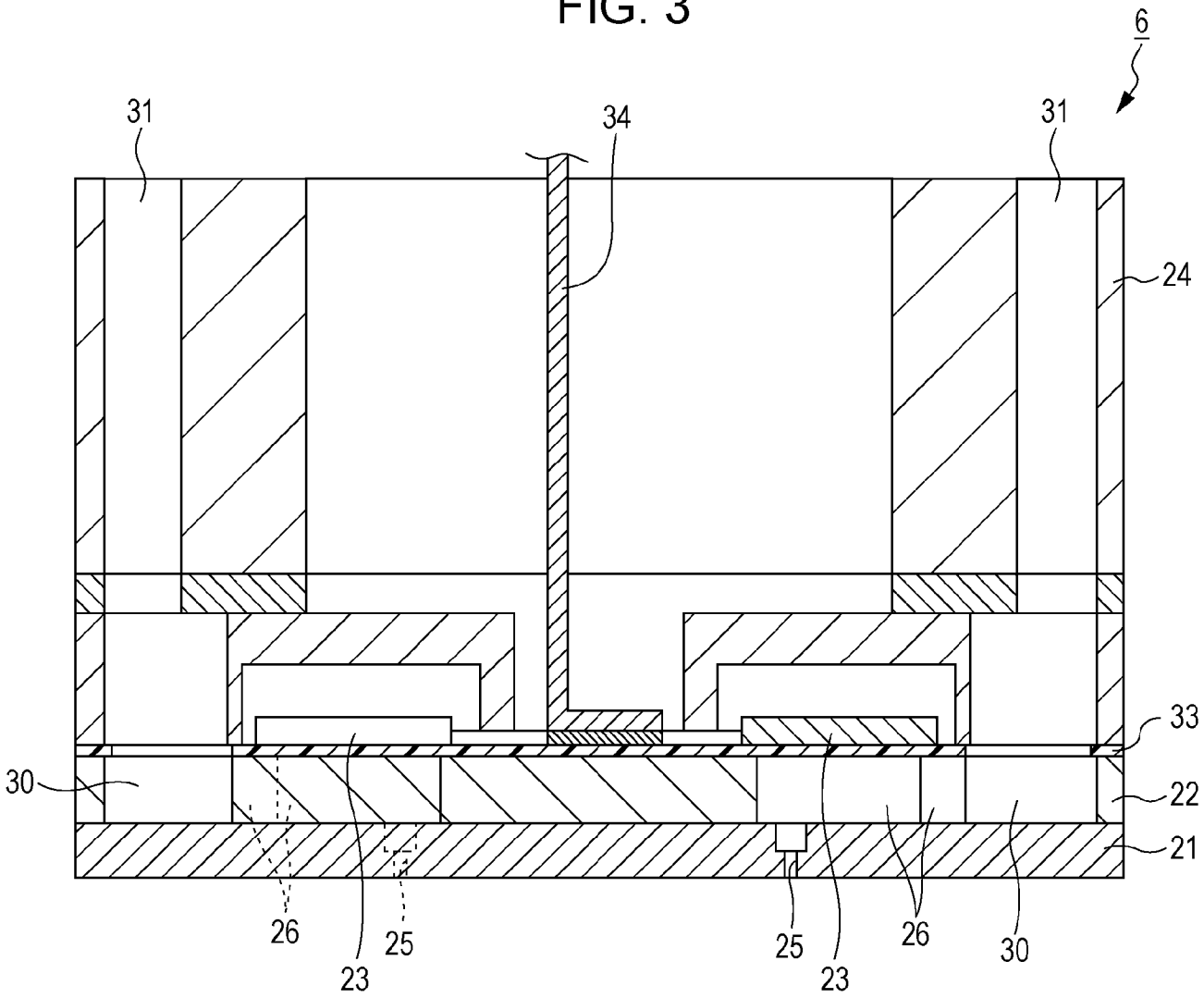
FIG. 3 is a cross sectional view for explaining a configuration of a recording head.
Figure 4:
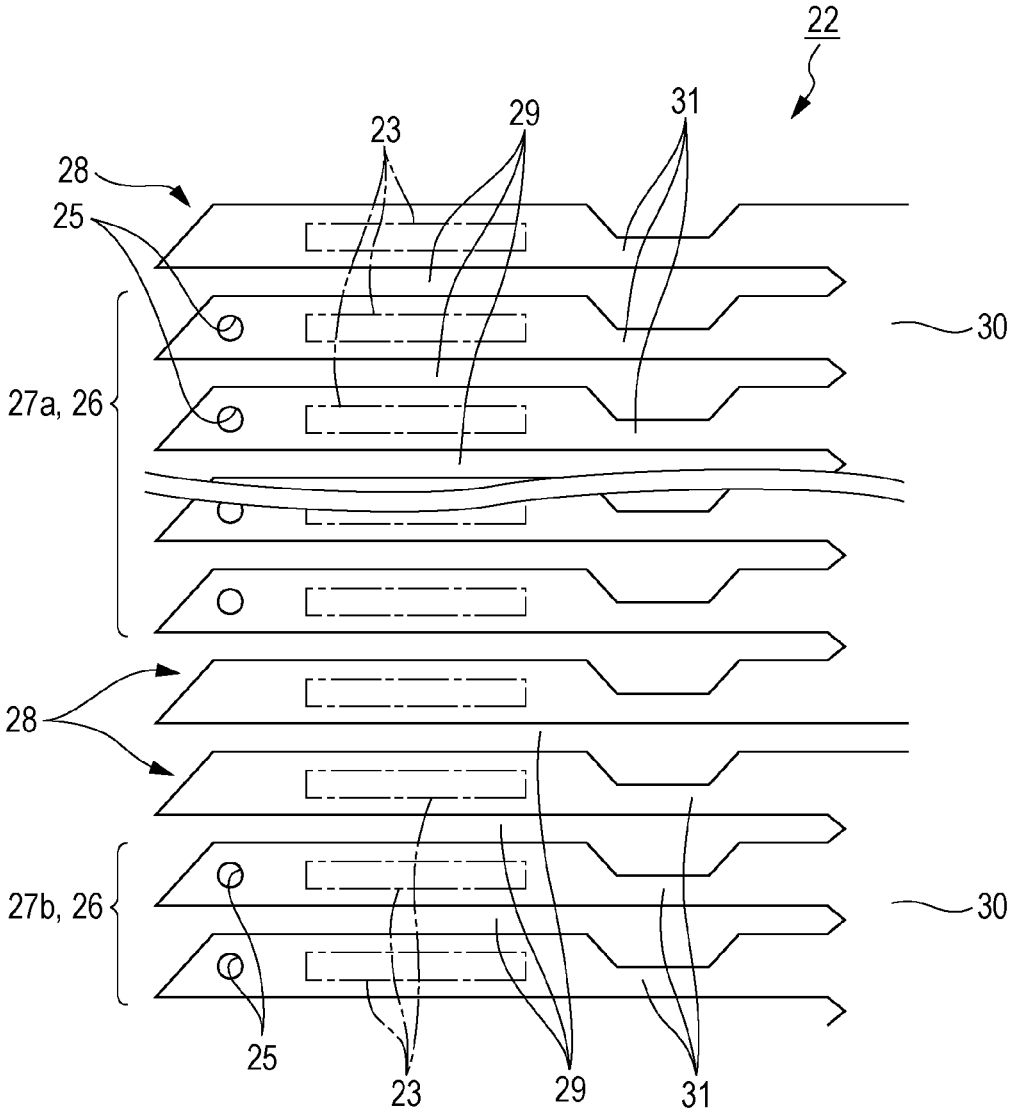
FIG. 4 is a partial top surface view for explaining a configuration of a flow path substrate.

FIG. 3 is an essential part cross sectional view for explaining an internal configuration of the recording head 6. In addition, FIG. 4 is a partial top surface view of a flow path substrate 22.

The recording head 6 according to the present embodiment is schematically formed of a nozzle plate 21, the flow path substrate 22, a piezoelectric element 23, and the like, and attached to a case 24 in a state where such members are stacked. The nozzle plate 21 is a member in which a plurality of nozzles 25 are installed in a row at a predetermined pitch and which has a plate shape. In the present embodiment, two nozzle arrays, each being configured by a plurality of linearly aligned nozzles 25 are linearly aligned on the nozzle plate 21.

The flow path substrate 22 is a plate member formed of a single crystal silicon substrate of a surface orientation (110) in the present embodiment. In the flow path substrate 22, a plurality of pressure chambers 26 are formed side by side in a direction of the nozzle array by anisotropic etching, and through such pressure chambers 26, a pressure chamber array 27 is constructed. The pressure chamber 26 according to the present embodiment is a long empty portion formed in a direction intersecting with a linear alignment direction of the pressure chamber. Each pressure chamber 26 is provided so as to correspond one-to-one to each nozzle 25 of the nozzle plate 21. That is, a pitch formed between pressure chambers 26 corresponds to a pitch formed between the nozzles 25. The pressure chamber array 27 according to the present embodiment is divided into a plurality of pressure chamber arrays, and inks of types (colors) different from each other are assigned for each pressure chamber array. That is, in FIG. 4, the pressure chamber array 27 is divided into a first pressure chamber array 27*a* and a second pressure chamber array 27*b*. Then, for example, cyan ink is filled into the first pressure chamber array 27*a* and magenta ink is filled into the second pressure chamber array 27*b*. Of course, there may be construction in such a manner that only one type of ink is assigned to all the pressure chambers 26 of the pressure chamber array 27.

In both end portions in the linear alignment direction of the pressure chambers of each pressure chamber array 27*a* or 27*b*, dummy pressure chambers 28 which do not perform ink ejection are formed respectively. That is, each pressure chamber array 27*a* or 27*b* according to the present embodiment has two dummy pressure chambers 28, respectively. In addition, in the present embodiment, two dummy pressure chambers 28 are formed on a boundary portion between the pressure chamber arrays adjacent to each other. In addition, the number of dummy pressure chambers 28 between the pressure chamber arrays is not limited to two, and may be one, or three or more. In addition, the dummy pressure chamber 28 may be provided between the pressure chamber groups 27, and may be provided at least on both ends of the whole of the pressure chamber array 27. In addition, the dummy pressure chamber 28 according to the present embodiment is an empty portion with the same dimensions and shape as those of the pressure chamber 26. In addition, an interval between the dummy pressure chamber 28 and the pressure chamber 26 adjacent to the dummy pressure chamber 28 is made uniform with an interval between other pressure chambers 26. Thus, a thickness (dimension in the linear alignment direction of the pressure chambers) of a partition wall 29 which partitions the dummy pressure chamber 28 and the pressure chamber 26 adjacent to the dummy pressure chamber 28 is made uniform with a thickness of a partition wall 29 which partitions the pressure chambers 26.

In addition, in the flow path substrate 22, in an area deviated toward a side (opposite side to a side communicating with the nozzles 25) in a longitudinal direction of the pressure chambers with respect to the pressure chamber 26 and the dummy pressure chamber 28, a reservoir 30 which penetrates the flow path substrate 22 is formed along the linear alignment direction of the pressure chambers 26 for each pressure chamber array. The reservoir 30 is an empty portion which is common to each pressure chamber 26 which belongs to the same pressure chamber array. The reservoir 30, each pressure chamber 26, and the dummy pressure chamber 28 communicate with each other via an ink supply path 31. The ink supply path 31 is formed with a narrower width than that of the pressure chamber 26, and is a portion which becomes a flow path resistance with respect to the ink which flows into the pressure chamber 26 from the reservoir 30. In addition, the ink from the ink cartridge 17 side flows into the reservoir 30 via the ink supply path 31 of the case 24.

The nozzle plate 21 is bonded to a bottom surface (surface of an opposite side to a bonded surface side respect to the actuator unit) of the flow path substrate 22 via a glue, a heat welding film, or the like. The nozzle plate 21 is a plate member in which the plurality of nozzles 25 are installed in a row at a predetermined pitch. In the present embodiment, the nozzle array is formed by providing 360 nozzles 25 in a row at a pitch corresponding to 360 dpi. Each nozzle 25 communicates with an end portion of an opposite side of the ink supply path 31 with respect to the pressure chamber 26. In the present embodiment, the nozzle 25 is not provided with respect to the dummy pressure chamber 28, but a construction in which the nozzle 25 communicates can also be employed in the dummy pressure chamber 28. In addition, for example, the nozzle plate 21 is formed of a glass-ceramic, a single crystal silicon substrate, stainless steel or the like. In the recording head 6 according to the present embodiment, a total of two rows of the nozzle arrays are provided, and a liquid flow path corresponding to each nozzle array is provided in bilateral symmetry with a nozzle 25 side set as an inside of the liquid flow path.

On a top surface of an opposite side of the nozzle plate 21 side to the flow path substrate 22, a piezoelectric element 23 is formed via an elastic film 33. That is, top openings of each pressure chamber 26 and the dummy pressure chamber 28 are blocked by the elastic film 33, and the piezoelectric element 23 is further formed thereon. The piezoelectric element 23 is formed by stacking in sequence a lower electrode film formed of metal, a piezoelectric layer, and an upper electrode film formed of metal (all are not illustrated). As the piezoelectric layer, a ferroelectric piezoelectric material such as lead zirconate titanate (PZT) which includes lead (Pb), titanium (Ti), and zirconium (Zr), or materials in which a metal oxide such as niobium oxide, nickel oxide, magnesium oxide, or the like is added thereto, or the like can be used. The piezoelectric element 23 is a piezoelectric element of a so-called bending mode. Each piezoelectric element 23 is deformed by applying a drive signal via a wiring member 41. As a result, a pressure variation occurs in the ink in the pressure chamber 26 corresponding to the piezoelectric element 23, and the ink is ejected from the nozzle 25 by controlling the pressure variation of the ink. The piezoelectric element 23 is also formed on the dummy pressure chamber 28, and is constructed so as to be able to be driven by the drive signal applied, in the same manner as the piezoelectric element 23 provided with respect to other pressure chambers 26.

Then, if the drive signal (that is, drive potential) described later is applied between upper and lower electrodes of the piezoelectric element 23, an electric field according to the applied potential (applied voltage) occurs between both electrodes. Then, the piezoelectric element is deformed according to a strength of the applied electric field. That is, as the applied potential increases, the elastic film 33 is deformed in such a manner that a center portion in a width direction (nozzle array direction) of the piezoelectric element is bent toward the nozzle plate 21, and a volume of the pressure chamber 26 (or dummy pressure chamber 28, hereinafter, the same) is decreased. In contrast, as the applied potential decreases (becomes closer to zero), the elastic film 33 is deformed in such a manner that a center portion in a short length direction of the piezoelectric element is bent to be separated from the nozzle plate 21, and the volume of the pressure chamber 26 is increased. In this way, if the piezoelectric element 23 is driven, the volume of the pressure chamber 26 is changed, and thus, a pressure of the ink in the pressure chamber 26 is changed. Then, by controlling the pressure change of the ink, it is possible to eject the ink droplets from the nozzle 25.

Next, an electrical configuration of the recording head 6 will be described.

As illustrated in FIG. 1, the recording head 6 includes a latch circuit 36, a decoder 37, a switch 38, and the piezoelectric element 23. The latch circuit 36, the decoder 37, and the switch 38 configure a head control unit 15, and the head control unit 15 is provided in each piezoelectric element 23, that is, in each nozzle 25. The latch circuit 36 latches ejection data based on the print data. The ejection data is data which controls ejection and non-ejection of the ink from each nozzle. Based on the ejection data which is latched in the latch circuit 36, the decoder 37 outputs a switch control signal which controls the switch 38. A switch control signal output from the decoder 37 is input to the switch 38. The switch 38 is a switch which is switched on or off according to the switch control signal.

FIGS. 5A and 5B are waveform diagrams for explaining a configuration of the drive signal which is generated by the drive signal generating unit 11, FIG. 5A illustrates a first drive signal COM1 (drive potential in a broad sense), and FIG. 5B illustrates a second drive signal COM2 (drive potential in a broad sense). In the present embodiment, a unit time period T which is a repeating period of such drive signals COM1 and COM2 corresponds to a time during which the nozzle 25 moves by a distance corresponding to an pixel width which is a configuration unit of the image, when the recording head 6 performs the ejection of the ink while relatively moving with respect to the recording medium S. Such drive signals COM1 and COM2 are generated according to a latch signal LAT which is a timing signal generated based on the encoder pulse according to a scan position of the recording head 6. Thus, the drive signals COM1 and COM2 are signals which are generated during a period defined by the latch signal LAT.

The printer 1 according to the present embodiment can perform multiple gradation recording which forms dots different from each other in size on the recording medium S, and in the present embodiment, it is configured in such a manner that a recording operation of a total of four gradations of a large dot, a medium dot, a small dot, and non-ejection (slight vibration) can be performed. Then, the first drive signal COM1 according to the present embodiment is a signal in which a first ejection drive pulse P1, a second ejection drive pulse P2, and a third ejection drive pulse P3 (all are drive potentials in a narrow sense) are generated in this order, within the unit time period T. In addition, in the second drive signal COM2 according to the present embodiment, a vibration drive pulse P4 (drive potential in a narrow sense) is generated. Then, when during print processing, the recording head 6 performs a constant movement within a recording area on the recording medium S, at least one of the drive pulses of the drive signals COM1 and COM2 is selectively applied to the piezoelectric elements 23 which are provided in each pressure chamber 26. In contrast, during the print processing, the second drive signal COM2 is constantly applied to the piezoelectric elements 23 which are provided in the dummy pressure chambers 28. That is, in the present embodiment, for each unit time period T, a reference potential Vb, the vibration drive pulse P4, and the reference potential Vb are applied in sequence to the piezoelectric elements 23 of the dummy pressure chambers 28. Thus, a certain potential is always applied to the piezoelectric elements 23 of the dummy pressure chambers 28. That is, a potential except for zero volts may be applied to the piezoelectric element 23, and the potential may be a constant potential such as the reference potential Vb, or may be a potential which changes according to lapse of time like the drive pulses P1 to P4.

The ejection drive pulses P1 to P3 are drive pulses in which waveforms are set so as to eject the ink from the nozzles 25. Specifically, the ejection drive pulses P1 to P3 are configured with an expansion element p1 which expands the pressure chamber 26 from a reference volume, an expansion maintenance element p2 which maintains an expansion state for a certain period of time, a contraction element p3 which rapidly contracts the pressure chamber 26 so as to eject the ink from the nozzle 25, a contraction maintenance element p4 which maintains a contraction state for a certain period of time, and an expansion return element p5 which returns a contracted volume to the reference volume. In contrast, the vibration drive pulse P4 is a drive pulse which is set to a waveform which can vibrate a meniscus to an extent that the ink is not ejected from the nozzle 25, in such a manner that thickening of the ink in the nozzle 25 is suppressed during the recording operation. Specifically, the vibration drive pulse P4 is configured with a vibration expansion element p6 which expands the pressure chamber 26 (or dummy pressure chamber 28) from the reference volume to a vibration expansion volume which is slightly larger, a vibration expansion maintenance element p7 which maintains the vibration expansion volume for a certain period of time, and a vibration return element p8 which returns the vibration expansion volume to the reference volume. All drive pulses also change with the reference potential Vb (reference voltage) as its base point. That is, a starting potential or an ending potential of each drive pulse becomes the reference potential Vb. Then, as illustrated in FIGS. 5A and 5B, the reference potential Vb is set to a higher potential than a ground potential GND.

FIGS. 6A to 6D are schematic diagrams for explanation with respect to a selection pattern of the drive signal according to a recording gradation of the print processing (recording processing). Here, in FIGS. 6A to 6D, a selection pattern of the drive signal which is applied to the piezoelectric element 23 corresponding to a normal pressure chamber 26 in which the ink ejection is performed, that is, a pressure chamber 26 other than the dummy pressure chamber 28 is denoted as "normal", and a selection pattern of the drive signal which is applied to the piezoelectric element 23 corresponding to the dummy pressure chamber 28 is denoted as "dummy".

Figure 6A:
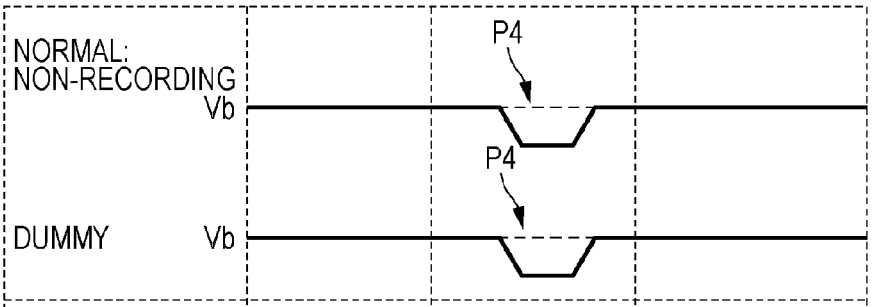
FIGS. 6A to 6D are schematic diagrams for explaining a selection control of drive pulses of the drive signal.

In the present embodiment, according to the number of selections of each ejection drive pulse included in the drive signals COM, the size of the dots which are formed on the recording medium S is changed. In a case of non-recording in which the dots are not formed on the recording medium S during the unit time period T, that is, the ink is not ejected from the nozzle 25, the second drive signal COM2 is applied to the piezoelectric element 23 corresponding to the non-recording nozzle 25, as illustrated in FIG. 6A. That is, the reference voltage Vb and the vibration drive pulse P4 generated in the middle of the vibration drive pulse are applied to the piezoelectric element 23. If the vibration drive pulse P4 is applied to the piezoelectric element 23, a relatively small pressure vibration is generated in the ink in the pressure chamber 26, and the meniscus which is exposed to the nozzle 25 vibrates (slightly vibrates) by the pressure variation. By the slight vibration of the meniscus, the thickened ink around the nozzle 25 is dispersed, and as a result, the thickening of the meniscus is decreased.

Figure 6B:
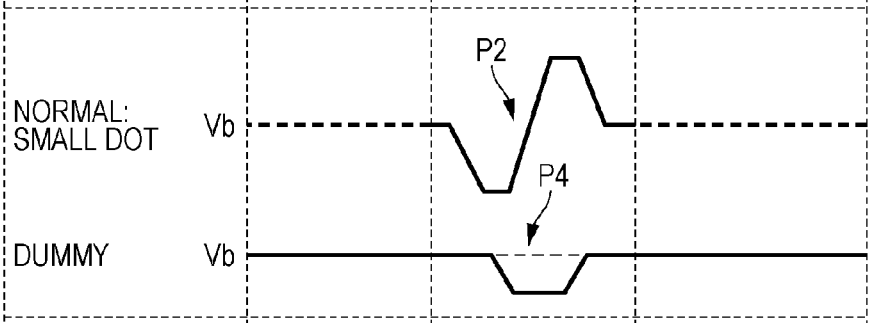
Figure 6C:
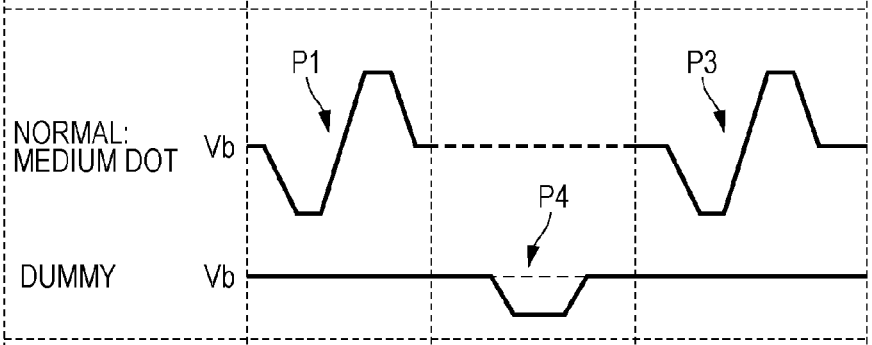
Figure 6D:
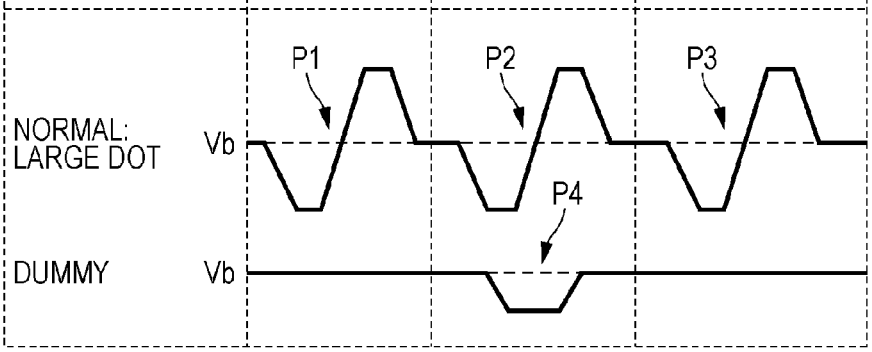

In a case where small dots are formed on the recording medium S during the unit time period T, the second ejection drive pulse P2 of the first drive signal COM1 is selected so as to be applied to the piezoelectric element 23, as illustrated in FIG. 6B. As a result, the ink is ejected from the nozzle 25 once, and the small dots are formed on the recording medium S. In addition, in a case where medium dots are formed on the recording medium S during the unit time period T, the first ejection drive pulse P1 and the third ejection drive pulse P3 of the first drive signal COM1 are selected so as to be applied in sequence to the piezoelectric element 23, as illustrated in FIG. 6C. As a result, the ink is ejected from the nozzle 25 twice consecutively. If such ink is landed in a predetermined pixel area of the recording medium S which is a recording medium, the medium dots are formed. In the same manner, in a case where large dots are formed on the recording medium S during the unit time period T, the first ejection drive pulse P1, the second ejection drive pulse P2 and the third ejection drive pulse P3 of the first drive signal COM1 are selected so as to be applied in sequence to the piezoelectric element 23, as illustrated in FIG. 6D. As a result, the ink is ejected from the nozzle 25 three consecutive times. If such ink is landed in a predetermined pixel area of the recording medium S which is a recording medium, the large dots are formed. In addition, the size of the dots is relative, and the size or liquid volume of the actual dots is determined according to a specification of the printer 1.

Here, in the printer 1 according to the invention, as illustrated in FIGS. 6A to 6D, the second drive signal COM2 is always applied to the piezoelectric element 23 which is provided in the dummy pressure chamber 28 during the print processing, and thus a difference of pressure loss between the pressure chamber 26 positioned at an end portion of the pressure chamber array 27 and other pressure chambers 26 positioned at an inside in the linear alignment direction of the pressure chambers rather than the pressure chamber 26 of the end portion, is decreased. In the present embodiment, regardless of whether or not the ink is ejected from the nozzle 25 of the pressure chamber 26 positioned at the end portion of the pressure chamber array 27 (regardless of any gradation of the non-recording, the small dots, the medium dots, and the large dots), the reference potential Vb, the vibration drive pulse P4, and the reference potential Vb are applied in sequence to the piezoelectric element 23 of the dummy pressure chamber 28 for each unit time period T, as described above, and thus any one of the drive potentials (potential except for zero volts) is always applied.

FIGS. 7A to 7D are schematic diagrams for explaining movement of the piezoelectric element 23 when the ink corresponding to the small dots is ejected at the pressure chamber 26 positioned at an end portion of the pressure chamber array 27, that is, the pressure chamber 26 adjacent to the dummy pressure chamber 28, and cross sectional views in a short length direction (linear alignment direction of the pressure chambers) of three pressure chambers including the dummy pressure chamber 28. In FIGS. 7A to 7D, the illustration of the elastic film 33 is omitted. In FIGS. 7A to 7D, the pressure chambers positioned at the left ends are dummy pressure chambers 28, and central pressure chambers are the pressure chambers 26 positioned at the end portions (end portions of the pressure chamber array 27) of the pressure chamber array. In addition, the central pressure chamber 26 is called appropriately an end portion pressure chamber 26, and the pressure chamber 26 positioned at an opposite side (right side in the figure) of the dummy pressure chamber 28 with respect to the end portion pressure chamber 26 is called appropriately a right-adjacent pressure chamber 26. Next, hereinafter, a case where the ink is ejected from the nozzle 25 of the end portion pressure chamber 26, while the ink is not ejected from the nozzle 25 of the right-adjacent pressure chamber 26, will be exemplified. That is, in the following examples, the central nozzle 25 is an ejecting nozzle, and a right-adjacent nozzle 25 is a non-ejecting nozzle.

Figure 7A:
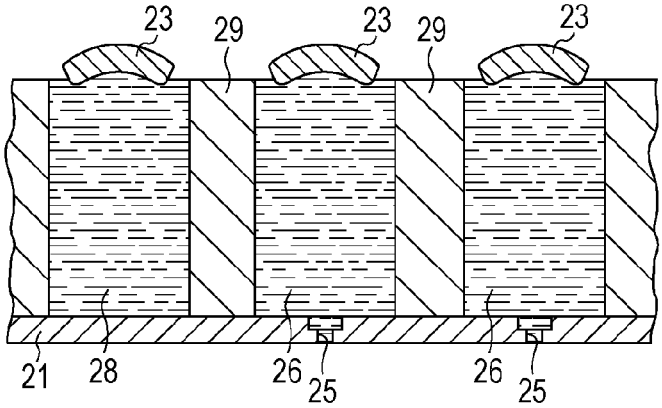
FIGS. 7A to 7D are schematic diagrams for explaining movement of a piezoelectric element when ink is ejected at an end portion pressure chamber adjacent to a dummy pressure chamber.
Figure 7B:
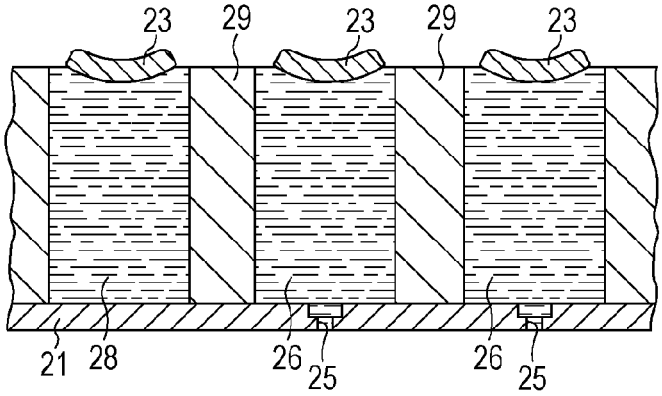

FIG. 7A illustrates an initial state where the drive signal COM, that is, the potential is not applied to all the piezoelectric elements 23. In the present embodiment, in the initial state, a center portion in a width direction (linear alignment direction of the pressure chambers) of the piezoelectric element 23 is bent slightly toward an upper side (to be separated from the nozzle plate 21). However, the initial state of the piezoelectric element 23 is dependent upon the composition or the like of the piezoelectric element 23. In a state where the potential is not applied to the piezoelectric element 23, the piezoelectric element 23 relaxes thereby becoming flexible. In contrast, FIG. 7B illustrates a state where the reference potential Vb of the drive signal is applied to each piezoelectric element 23. In this state (reference state), the center portion in the width direction of the piezoelectric element 23 is positioned at an inside of the pressure chambers 26 and 28 with respect to an opening surface of the pressure chambers 26 and 28. In a state where the potential is applied to the piezoelectric element 23, the piezoelectric element 23 is tensed. As a result, the rigidity of the piezoelectric element 23 at this time is greater than the rigidity in a state where the potential is not applied. Hereinafter, while the ink in at least the pressure chamber 26 adjacent to the dummy pressure chamber 28 is ejected, the second drive signal COM2 is continuously applied to the piezoelectric element 23 of the dummy pressure chamber 28.

Figure 7C:
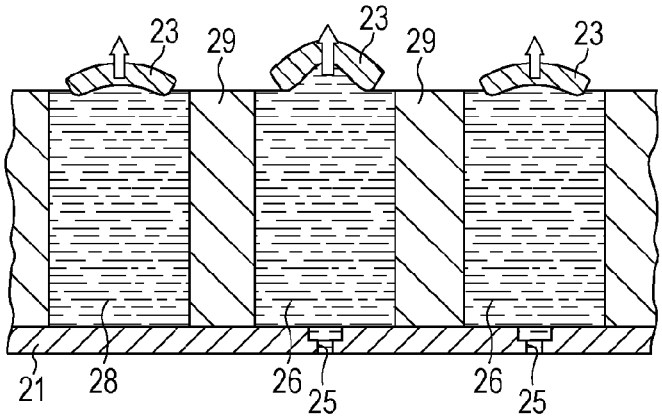

Then, the expansion element p1 of the second ejection drive pulse P2 of the first drive signal COM1 is applied to the piezoelectric element 23 of the end portion pressure chamber 26, and as illustrated by white arrows in FIG. 7C, the center portion in the width direction of the piezoelectric element 23 corresponding to the ejecting nozzle is bent toward an outside with respect to the opening surface of the pressure chamber 26. As a result, the pressure chamber 26 expands from the reference volume corresponding to the reference potential Vb to an expanded volume. In addition, the vibration expansion element p6 of the vibration drive pulse P4 of the second drive signal COM2 is applied to the piezoelectric element 23 of the dummy pressure chamber 28 and the piezoelectric element 23 of the right-adjacent pressure chamber 26, respectively. As a result, the center portion in the width direction of the piezoelectric element 23 is slightly bent toward the outside with respect to the opening surface of the pressure chambers 26 and 28. As a result, the right-adjacent pressure chamber 26 and the dummy pressure chamber 28 expand slightly from the reference volume corresponding to the reference potential Vb to the vibration expansion volume.

Figure 7D:
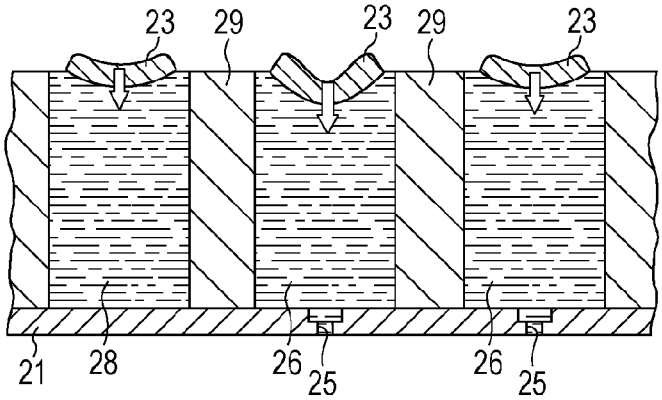

After an expansion state of the end portion pressure chamber 26 is maintained over the supply period of the expansion hold element p2 of the second ejection drive pulse P2, the contraction element p3 of the second ejection drive pulse P2 is applied, and thus as illustrated by the arrows in FIG. 7D, the center portion of the piezoelectric element 23 is bent rapidly toward the inside (lower side) of the pressure chamber 26. As a result, the pressure chamber 26 contracts rapidly from the expanded volume to the contracted volume. By the rapid contraction of the pressure chamber 26, the pressure in the pressure chamber 26 increases rapidly, and by the rising of the pressure, the ink of a specified amount (for example, several ng to several dozen ng) is ejected from the nozzle 25. In contrast, after maintaining over the application period of the vibration expansion hold element p7 of the vibration drive pulse P4, the vibration return element p8 is applied to the piezoelectric element 23 of the dummy pressure chamber 28 and the piezoelectric element 23 of the right-adjacent pressure chamber 26, respectively. As a result, the center portion in the width direction of the piezoelectric element 23 is slightly bent toward the inside with respect to the opening surface of the pressure chambers 26 and 28, and the right-adjacent pressure chamber 26 and the dummy pressure chamber 28 expand slightly from the vibration expansion volume to the reference volume thereby being returned to the reference volume. According to the volume change, a relatively small pressure variation occurs in the ink of the inside of the dummy pressure chamber 28 and the right-adjacent pressure chamber 26. Then, the meniscus vibrates in the nozzle 25 of the right-adjacent pressure chamber 26.

Here, while an operation of ejection of the ink from the nozzle 25 of the end portion pressure chamber 26 is performed, the second drive signal COM2 is continuously applied to the piezoelectric element 23 of the dummy pressure chamber 28, that is, in the present embodiment, at least the reference potential Vb or the slight vibration drive pulses P4 is applied, thus the piezoelectric element 23 is tensed, and thereby the partition wall 29 between the end portion pressure chambers 26 is supported (pressed against the end portion pressure chamber 26 side) from the side. As a result, even if an internal pressure of the end portion pressure chamber 26 increases, the partition wall 29 is suppressed from being deformed (bent) toward the dummy pressure chamber 28 side. Due to this, it is possible to reduce the pressure loss toward the dummy pressure chamber 28 side from the end portion pressure chamber 26. In contrast, since the partition wall 29 is supported by the tensed piezoelectric element 23, the rigidity of the partition wall 29 is not excessively great, when compared with a configuration (configuration in which one side of the end portion pressure chamber 26 is a wall having a greater rigidity than that of the partition wall 29) in which the dummy pressure chamber 28 is not provided. Thus, it is possible to make uniform a deformation degree of the partition wall 29 on the dummy pressure chamber 28 side and a deformation degree of the partition wall 29 on the other pressure chamber 26 side to the same degree, when the pressure variation occurs in the end portion pressure chamber 26 adjacent to the dummy pressure chamber 28. As a result, it is possible to make uniform the pressure loss due to a propagation of the pressure variation, at the end portion pressure chamber 26 and other pressure chambers 26 in the same degree as each other. As a result, it is possible to make uniform characteristics of the ejection of the liquid of each pressure chamber 26 in the pressure chamber array or the pressure chamber array 27. Due to this, it is possible to cope with a high density of the nozzles 25 (pressure chambers 26) or miniaturization of the recording head 6. In addition, three is suitability for a case where a substrate (flow path substrate 22 in the present embodiment) which forms the pressure chamber 26 is produced by materials with a relatively weak rigidity such as a single crystal silicon substrate.

In the present embodiment, since at least the reference potential Vb is applied to the piezoelectric element 23 of the dummy pressure chamber 28, it is possible to average approximately the rigidities of the partition walls 29 on both sides of the end portion pressure chamber 26, and to easily make uniform the ejection characteristics, regardless of the ejection or non-ejection of the ink in the right-adjacent pressure chamber 26 with respect to the end portion pressure chamber 26. In addition, in the present embodiment, the pressure chamber array 27 is divided into a plurality of pressure chamber arrays, the dummy pressure chamber 28 is provided between each pressure chamber array, inks of types (colors) different from each other are assigned to each pressure chamber array, and thus, it is not necessary to provide a dedicated nozzle array (pressure chamber array) or a dedicated recording head for each color, and it is possible to use together multiple types of inks in one nozzle array (pressure chamber array). Furthermore, in the present embodiment, the ink is filled into the dummy pressure chamber 28 in the same manner as other pressure chambers 26, and thus it is possible to make uniform a compressive stress on the ink in the dummy pressure chamber 28 when the pressure variation occurs in the end portion pressure chamber 26, with a compressive stress in the right-adjacent pressure chamber 26 with respect to the end portion pressure chamber 26. Due to this, it is possible to more reliably make uniform the ejection characteristics of each pressure chamber 26.

In addition, in the present embodiment, since the reference potential Vb and the slight vibration drive pulse P4 are applied to the piezoelectric element 23 provided in the pressure chamber 28 (including the dummy pressure chamber 28) in which the ink is not ejected during the unit time period T, thereby enabling the piezoelectric element 23 to generate heat, it is possible to reduce a temperature difference between the ink in the pressure chamber 28 in which the ink is not ejected and the ink in the pressure chamber 28 in which the ink is ejected. That is, since a viscosity of the ink changes according to temperature, if a state where no drive potential is applied to the piezoelectric element 23 of the pressure chamber 28 in which the ink is not ejected is continued, there occurs a difference in ink viscosity between pressure chambers 28 in which the ink is relatively frequently ejected, and due to variation of the ink viscosity, an ejection property (an amount or a flying speed of the ink being ejected) of the ink varies in each pressure chamber. If the ejection characteristics of the ink vary, there is a concern that an image quality of the recording image or the like may decrease. In contrast, in the present embodiment, since it is possible to reduce a temperature difference between the ink in the pressure chamber 28 in which the ink is not ejected and the ink in the pressure chamber 28 in which the ink is ejected, it is possible to suppress the variation of the ink ejection characteristics between the pressure chambers. As a result, it is possible to reduce a decrease of the image quality of the recording image or the like.

In addition, in the above-described embodiment, a configuration in which the reference potential Vb and the vibration drive pulse P4 are applied to the piezoelectric element 23 of the dummy pressure chamber 28 is exemplified, but the present embodiment is not limited thereto, and for example, it is possible to employ a configuration in which only the reference potential Vb is continuously applied. In short, while an operation of ejecting the ink from the nozzle 25 of at least the end portion pressure chambers 26 adjacent to the dummy pressure chamber 28 across the partition wall 29 is performed (that is, while the ejection drive pulse is applied to the piezoelectric element 23 of the end portion pressure chamber 26), any potential except for zero volts may be applied to the piezoelectric element 23 of the dummy pressure chamber 28. That is, for example, in the same manner as the first drive signal COM1, the drive signal (drive pulse) used for ejecting the ink may be applied to the piezoelectric element 23 of the dummy pressure chamber 28. Thus, in the above-described embodiment, a configuration in which a plurality of drive signals such as the first drive signal COM1 and the second drive signal COM2 are generated is exemplified, but the present embodiment is not limited thereto, and for example, there may be a configuration with only the first drive signal COM1. In addition, a configuration of the drive signal COM (the number or the type of the drive pulses generated within the unit time period) is also not limited to that exemplified in the above-described embodiment, and it is possible to employ various configurations.

In addition, in the above-described embodiment, a configuration in which the ink is filled into the dummy pressure chamber 28 in the same manner as in other pressure chamber 26 is exemplified, but the embodiment is not limited thereto, and the ink may not be filled into the dummy pressure chamber 28. That is, since the potential is applied to the piezoelectric element 23 of the dummy pressure chamber 28 so as to tense the piezoelectric element 23 thereby to support the partition wall 29, and effects of the invention can be obtained, although the dummy pressure chamber 28 is not filled with ink. In addition, a configuration in which the nozzle is not provided with respect to the dummy pressure chamber 28 is exemplified, but the nozzle may be or may not be provided with respect to the dummy pressure chamber 28.

Furthermore, in the present embodiment, the dummy pressure chambers 28 are positioned at both ends of each pressure chamber array 27*a* and 27*b*, but may be provided at both ends of at least the pressure chamber array 27.

In addition, in the present embodiment, as the piezoelectric element, the so-called flexural vibration type piezoelectric element 23 is exemplified, but the present embodiment is not limited thereto, and for example, a so-called longitudinal vibration type piezoelectric element can also be employed. In this case, the drive pulse exemplified in the above-described embodiment has the waveforms in which the direction of change of the potential is reversed, that is, vertically reversed. Also in this configuration, during the period in which an operation of ejecting the ink from the nozzle 25 of at least the end portion pressure chamber 26 is performed, if a certain potential is applied to the piezoelectric element 23 of the dummy pressure chamber 28, the same actions and effects as in the above-described embodiment can be obtained.

In addition, in the above-described embodiment, the nozzle array in which the nozzles 25 are arranged in a linear form is exemplified, but the embodiment is not limited thereto, and it is possible to apply the invention by regarding a nozzle group arranged in a non-linear shape such as a zigzag or a serpentine shape as a nozzle array, and by regarding a pressure chamber array corresponding to such a nozzle group as a pressure chamber array. For example, each of nozzles may be arranged in the linear alignment direction differently from each other (in a zigzag manner). In this case, the dummy pressure chambers are arranged so as to be adjacent to the pressure chambers corresponding to the nozzles of both ends in the linear alignment direction of the nozzle group regarded as the nozzle array. In the same manner, the invention can also be applied to a configuration in which the nozzles are arranged in a matrix. That is, in a case of this configuration, it is regarded that a plurality of nozzle arrays and a plurality of pressure chamber arrays are linearly aligned, and thus, the dummy pressure chambers are arranged so as to be adjacent to the pressure chambers corresponding to the nozzles of both ends of each nozzle array.

Figure 8A:
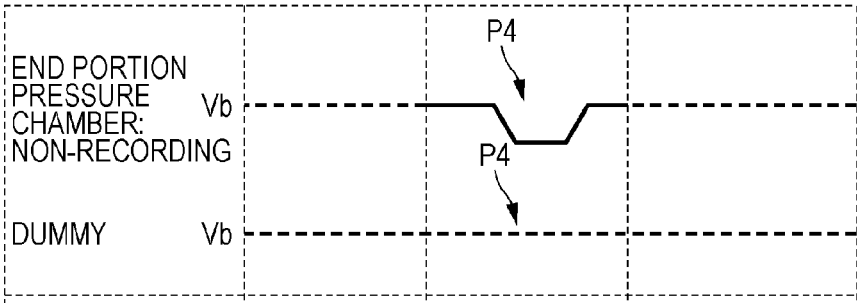
FIGS. 8A to 8D are waveform diagrams for explaining a selection pattern of drive pulses according to a second embodiment of the invention.
Figure 8B:
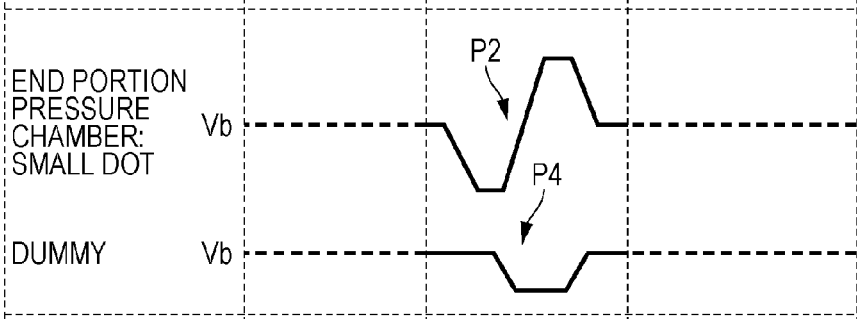
Figure 8C:
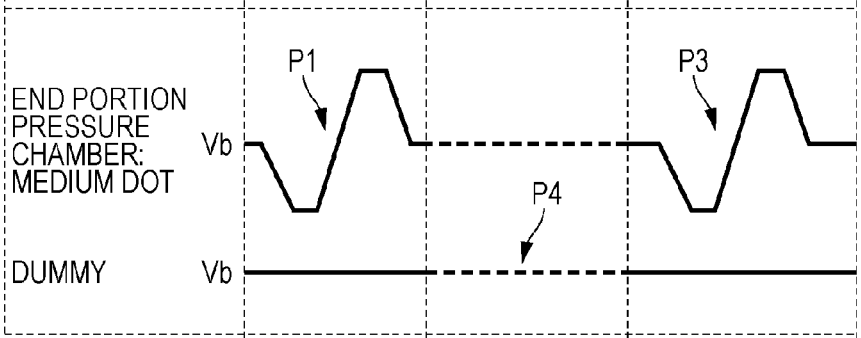
Figure 8D:
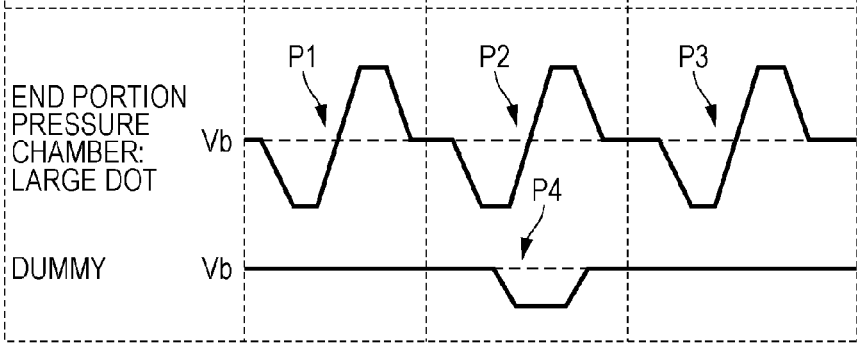

FIGS. 8A to 8D are waveform diagrams for explaining selection patterns of drive pulses corresponding to each piezoelectric element 23 of the end portion pressure chamber 26 and the dummy pressure chamber 28 according to a second embodiment of the invention. In FIGS. 8A to 8D, solid lines illustrate portions which are actually applied to the piezoelectric element 23, and dashed lines illustrate portions which are not applied to the piezoelectric element 23. In the present embodiment, the drive potential which is applied to the piezoelectric element 23 of the dummy pressure chamber 28 changes according to the drive pulse which is applied to the piezoelectric element 23 of the end portion pressure chamber 26, and this is a difference from the first embodiment described above. While the ejection of the ink is performed from the nozzle 25 of the end portion pressure chamber 26, that is, only while an ejection drive pulse DP is applied to the piezoelectric element 23 of the end portion pressure chamber 26 (for example, shorter time periods t1, t2, and t3 than the unit time period T), the second drive signal COM2 is partially applied to the piezoelectric element 23 of the dummy pressure chamber 28. Thus, as illustrated in FIG. 8A, in a case where only the vibration drive pulse P4 is applied to the piezoelectric element 23 of the end portion pressure chamber 26 (the ejection of the ink is not performed), no drive potential is applied to the piezoelectric element 23 of the dummy pressure chamber 28. In addition, as illustrated in FIG. 8B, in a case where only the second ejection drive pulse P2 is applied to the piezoelectric element 23 of the end portion pressure chamber 26 during the time period t2 (small dot ink is ejected), only the vibration drive pulse P4 of the second drive signal COM2 corresponding to the time period t2 is applied to the piezoelectric element 23 of the dummy pressure chamber 28 (the reference potential Vb is not applied during the time periods t1 and t3). In the same manner, as illustrated in FIG. 8C, in a case where the first ejection drive pulse P1 and the third ejection drive pulse P3 are applied to the piezoelectric element 23 of the end portion pressure chamber 26 during the time period t1 (medium dot ink is ejected), the reference potential Vb of the second drive signal COM2 corresponding to the time periods t1 and t3 is applied to the piezoelectric element 23 of the dummy pressure chamber 28 (the vibration drive pulse P4 is not applied during the time period t2). Then, in a case where all the ejection drive pulses P1 to P3 are applied to the piezoelectric element 23 of the end portion pressure chamber 26 during the time periods t1 to t3 (large dot ink is ejected), as illustrated in FIG. 8D, all signals of the second drive signal COM2 corresponding to the time periods t1 to t3 are applied to the piezoelectric element 23 of the dummy pressure chamber 28. Even by the configuration, the same actions and effects as in the first embodiment is obtained. In addition, since the other configurations are the same as in the first embodiment, description thereof will be omitted.

Then, the invention can be applied to any liquid ejecting apparatus which can control the ejection of the liquid by applying the drive pulse for driving the piezoelectric element, without being limited to a printer, and can also be applied to various ink jet type recording apparatuses, such as a plotter, a facsimile machine, and a copy machine.

What is claimed is:

1. A liquid ejecting apparatus comprising:

a liquid ejecting head that includes a nozzle array formed of a plurality of nozzles, a pressure chamber array formed of a plurality of pressure chambers provided along the nozzle array, and a plurality of piezoelectric elements which generate a pressure variation of liquid in each pressure chamber; and a drive potential generator that generates a drive potential which drives the piezoelectric element, wherein the pressure chamber array includes one or more dummy pressure chambers in which ejection of the liquid is not performed, and the one or more dummy pressure chambers each include one of the piezoelectric elements, and wherein the drive potential generator continues to apply the drive potential to the piezoelectric element corresponding to the dummy pressure chamber, while the ejection of the liquid from a nozzle of at least a pressure chamber adjacent to the dummy pressure chamber is performed, wherein the drive potential includes a first waveform that is applied to the pressure chamber adjacent to the dummy pressure chamber when the liquid is ejected and a second waveform different from the first waveform that is applied to the dummy pressure chamber when the liquid is ejected from the pressure chamber adjacent to the dummy pressure chamber.

2. The liquid ejecting apparatus according to claim 1, wherein the first waveform includes an ejection drive waveform, wherein a drive potential which is applied to the piezoelectric element of the dummy pressure chamber is a reference potential which that includes the ejection drive waveform and causes the piezoelectric elements of other pressure chambers to perform the ejection of the liquid.

3. The liquid ejecting apparatus according to claim 1, wherein the pressure chamber array is divided into a plurality of pressure chamber arrays, and wherein the dummy pressure chambers are formed on both sides of each pressure chamber array.

4. The liquid ejecting apparatus according to claim 1, wherein the liquid does not flow into the dummy pressure chamber.

5. The liquid ejecting apparatus according to claim 1, wherein the liquid of the same type as the liquid which flows into the pressure chamber adjacent to the dummy pressure chamber flows into the dummy pressure chamber.

6. A method of controlling a liquid ejecting apparatus which includes a liquid ejecting head that includes a nozzle array formed of a plurality of nozzles, a pressure chamber array formed of a plurality of pressure chambers provided along the nozzle array, and a plurality of piezoelectric elements which generate a pressure variation of liquid in each pressure chamber; and a drive potential generator that generates a drive potential which drives the piezoelectric element, and in which the pressure chamber array includes one or more dummy pressure chambers in which ejection of the liquid is not performed, and the dummy pressure chamber includes the piezoelectric element, the method comprising:

continuously applying the drive potential to the piezoelectric element corresponding to the dummy pressure chamber, while the ejection of the liquid from a nozzle of at least a pressure chamber adjacent to the dummy pressure chamber is performed, wherein the drive potential includes a first waveform that is applied to the pressure chamber adjacent to the dummy pressure chamber when the liquid is ejected and a second waveform different from the first waveform that is applied to the dummy pressure chamber when the liquid is ejected from the pressure chamber adjacent to the dummy pressure chamber.

* * * * *